US005845417A

United States Patent [19]

Reed et al.

[11] Patent Number: 5,845,417

[45] Date of Patent: Dec. 8, 1998

[54] AIR COOLED SHOE HAVING AN AIR EXHAUST PUMP

[75] Inventors: Rusty Allen Reed, Grand Prairie, Tex.; Mark D. Murrell, 424 Halifax, Coppell, Tex. 75243

[73] Assignees: Rusty A. Reed, Grand Prairie; Mark D. Murrell, Coppell, both of Tex.

[21] Appl. No.: 517,877

[22] Filed: Aug. 3, 1995

Related U.S. Application Data

[63] Continuation-in-part of Ser. No. 325,678, Oct. 19, 1994, abandoned, and a continuation of Ser. No. 648,861, May 6, 1996, Pat. No. 5,697,170.

[51] Int. Cl.[6] ..... A43B 7/06

[52] U.S. Cl. ..... 36/3 B; 36/3 R

[58] Field of Search ..... 36/29, 3 R, 3 A, 36/3 B

[56] References Cited

U.S. PATENT DOCUMENTS

| | | | |
|---|---|---|---|
| 426,495 | 4/1890 | Falkner . | |
| 655,576 | 8/1900 | Pearson . | |
| 890,966 | 6/1908 | Critz, Jr. . | |
| 940,856 | 11/1909 | Critz, Jr. . | |
| 1,364,226 | 1/1921 | Wherry . | |
| 1,660,698 | 10/1928 | Williams, Sr. . | |
| 2,329,573 | 9/1943 | Ziegliss | 36/3 R |
| 2,354,407 | 7/1944 | Shaks | 36/3 R |
| 2,716,293 | 8/1955 | Rath | 36/3 R |
| 2,751,692 | 6/1956 | Cortina | 36/3 R |
| 3,331,146 | 7/1967 | Karras | 36/3 R |
| 3,533,171 | 10/1970 | Motoki | 36/3 R |
| 3,791,051 | 2/1974 | Kamimura | 36/3 R |
| 3,973,336 | 8/1976 | Ahn | 36/3 R |
| 4,420,893 | 12/1983 | Stephan | 36/3 R |
| 4,776,110 | 10/1988 | Shiang | 36/3 R |
| 4,995,173 | 2/1991 | Spier | 36/29 |
| 4,999,932 | 3/1991 | Grim | 36/88 |
| 5,068,981 | 12/1991 | Jung | 36/3 R |
| 5,113,599 | 5/1992 | Cohen et al. | 36/88 |
| 5,179,792 | 1/1993 | Brantingham | 36/29 |
| 5,195,257 | 3/1993 | Holcomb et al. | 36/3 B X |
| 5,224,277 | 7/1993 | Sang Do | 36/27 |
| 5,233,767 | 8/1993 | Kramer | 36/28 |
| 5,253,435 | 10/1993 | Auger et al. | 36/88 |
| 5,257,470 | 11/1993 | Auger et al. | 36/88 |
| 5,295,313 | 3/1994 | Lee | 36/3 R |
| 5,341,581 | 8/1994 | Huang | 36/3 R |
| 5,351,710 | 10/1994 | Phillips | 137/233 |
| 5,353,525 | 10/1994 | Grim | 36/88 |
| 5,375,345 | 12/1994 | Djuric | 36/3 R |
| 5,408,760 | 4/1995 | Tse et al. | 36/3 R X |
| 5,477,626 | 12/1995 | Kwon | 36/3 R |
| 5,505,010 | 4/1996 | Fukuoka | 36/3 R |
| 5,638,612 | 6/1997 | Donzis | 36/3 R X |

FOREIGN PATENT DOCUMENTS

| | | | |
|---|---|---|---|
| 640720 | 12/1936 | Germany . | |
| 89045 | 4/1937 | Sweden | 36/3 R |
| 2 193 080 | 2/1988 | United Kingdom . | |
| 2 240 254 | 7/1991 | United Kingdom . | |
| 2 262 024 | 6/1993 | United Kingdom . | |

*Primary Examiner*—B. Dayoan
*Attorney, Agent, or Firm*—Mark W. Handley; Gregory M. Howison; Joe H. Shallenburger

[57] ABSTRACT

A ventilated shoe for ventilating the foot contains an outer sole (204). A heel pad (206) is disposed at the rear end of the outer sole (204). An intake tube (228) is disposed near the front of the outer sole (204). The intake tube (228) is connected to pump cell (210). An exhaust tube (234) is also connected to pump cell (210). An intake valve (242) is disposed along the intake tube (228) and an exhaust valve (244) is disposed along the exhaust valve (244). The intake valve (242) only allows air to flow through to the pump (210). The exhaust valve (244) only allows air to flow out of the pump cell (210). The pump cell (210) is filled with an open-celled foam (212) so that when no pressure is being applied to the pump cell (210), it draws air in through the intake tube (228). When pressure is applied to the pump cell (210), the open-celled foam (212) is compressed and the air is expelled through the exhaust tube (234).

11 Claims, 10 Drawing Sheets

AIR COOLED SHOE HAVING AN AIR EXHAUST PUMP

CROSS-REFERENCE TO RELATED APPLICATION

This application is a continuation in part of U.S. patent application Ser. No. 08/325,678, filed Oct. 19, 1994 abandoned, and entitled "AIR COOLED SOLE", abandoned, and continued in U.S. patent application Ser. No. 08/648,861, filed May 6, 1996, and issued as U.S. Pat. No. 5,697,170 on Dec. 16, 1997.

TECHNICAL FIELD OF THE INVENTION

The present invention relates to a ventilated shoe and, more particularly, to a shoe having an air-pumping device to ventilate the shoe.

BACKGROUND OF THE INVENTION

Presently known ventilated shoes comprise elastomeric and resilient pads which are made of soft materials, such as sponge or rubber, and contain a plurality of holes in the sole and in the heel of the shoe in order to increase foot comfort. In these types of insoles, it is very difficult to remove moisture and the odor produced as a result of moisture which collects in the shoe due to foot sweating caused by poor shoe ventilation. Since most people use their shoes for long periods of time, it is essential to properly maintain and ventilate the shoes in order to avoid foot diseases, such as, for example, water-eczema.

According to a report of the American Podiatry Association, 75 percent of the males and females stand or walk for 4 hours a day. Such foot stress leads to foot problems, particularly in males, where athlete's foot fungi and the odor associated therewith have become a common problem.

SUMMARY OF THE INVENTION

The present invention disclosed and claimed herein comprises an air-cooled shoe operable to ventilate the interior of the shoe and the area around a human foot. An outer sole having a toe portion, a ball portion and a heel portion is provided. A shoe upper formed above the outer sole and attached to the outer sole is provided. A pump array is disposed above the ball portion of the outer sole. The pump array includes an air-tight pump cell which is defined by a flexible material and filled with an open cell material which causes the pump cell to expand and fill with air. The pump cell has an air intake disposed on the toe portion of the outer sole and an air exhaust connected to the outside ambient air. A semi-rigid layer is disposed over the entirety of the pump array. Two one-way valves are disposed in a detachable pod which allow air to enter the pump array in one direction and to exit the pump array in one direction.

In another aspect of the present invention, the pump cell has an intake/exhaust having a first and second end, with the first end connected to the pump cell and the second end connected to the one-way valve, allowing air to exit only through the exhaust and another one-way valve allowing air to enter only through the intake.

In a further aspect of the present invention, a first one-way valve is disposed along an air inlet and a second one-way valve is disposed along an exhaust. The first one-way valve allows air to enter the pump cell only through the inlet and the second one-way valve allows the air to exit only through the exhaust.

In yet a further aspect of the present invention, a shutoff valve may be disposed along the air intake for stopping air and liquid from passing through the air intake.

In yet a further aspect of the present invention, the air intake may be attached to a filtering device for filtering out large particles which are too large to be carried through the pump.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1A:
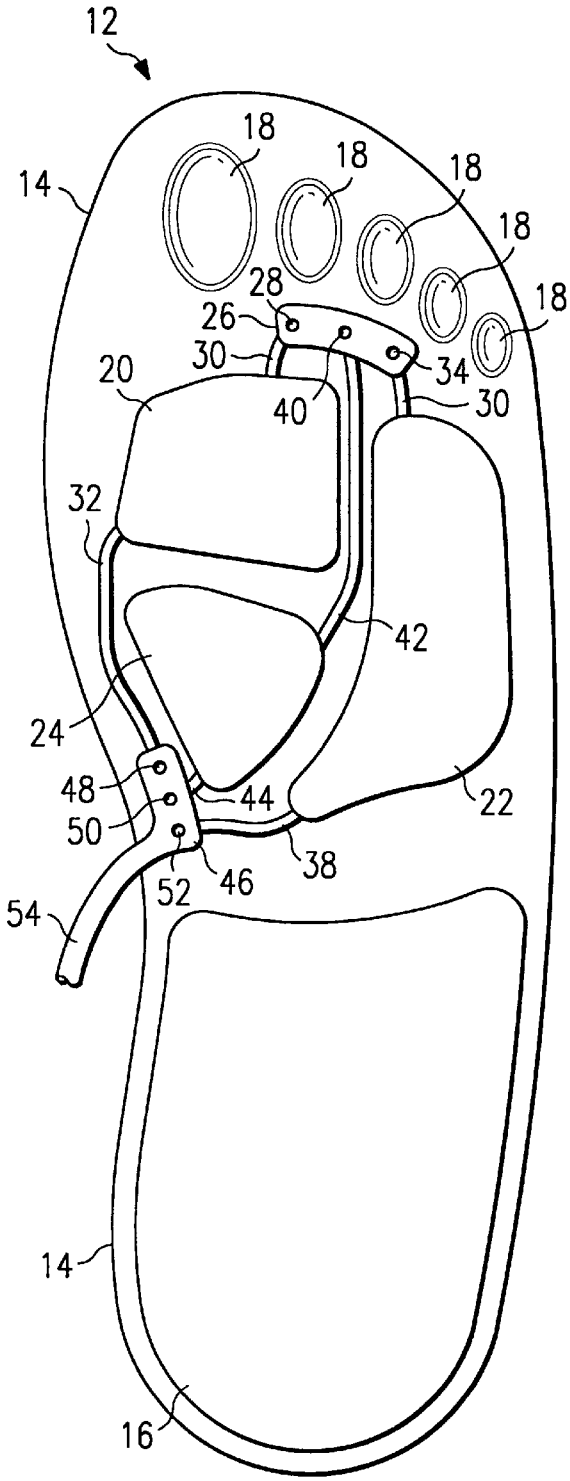
FIG. 1*a* illustrates a cutaway view of the system of the present invention.

Referring now to FIG. 1*a*, there is illustrated a cutaway view of the system of the present invention. A sole 12 is provided as part of an overall shoe (not shown). An outer sole 14 is provided and is roughly in the shape of a human foot (not shown), which fits over the top of the sole 12. A heel pad 16 is disposed on the top of the outer sole 14 and covers the rear one-third area of the outer sole 14. Toe impressions 18 are provided at the front edge of the outer sole 14. The toe impressions 18 are slightly impressed areas of the outer sole 14 and are placed to coincide at the locations of the toes of a human foot (not shown), when placed over the sole 12. A front pump cell 20 is provided and is placed on top of the outer sole 14, such that it corresponds to the head of the metatarsus of the first shaft of the human foot and of the second shaft of the human foot, extending approximately halfway up the first and second shafts from the head towards the base. A right pump cell 22 is provided and placed above the outer sole 14. The right pump cell 22 corresponds to the area between the head and the base of the metatarsus of the third, fourth, and fifth shaft. A rear pump cell 24 is provided and placed on top of the outer sole 14. The location of the rear pump cell 24 corresponds to the location of the base of the metatarsus of the first and second shaft to midway between the base and the head of the metatarsus of the first and second shaft.

An intake manifold 26 is provided and located between the toe impressions 18 in the front of the front pump cell 20 and the right pump cell 22. The intake manifold 26 is located such that it coincides the phalanges of the first through fifth shaft of the human foot. A front intake reed 28 is provided on the left side of the intake manifold 26 and is connected through a front intake tube 30 to the front pump cell 20. A rear intake reed 40 is provided in the center of the intake manifold 26 and is connected by a rear intake tube 42 to the rear pump cell 24. A right intake reed 34 is provided on the right side of the intake manifold 26 and is connected by the right intake tube 36 to the right pump cell 22. The intake reeds 28, 40 and 34 allow air to flow only in one direction into the pump cells 20, 22 and 24. An exhaust manifold 46 is provided and placed on the outer sole 14 of the sole 12. The exhaust manifold 46 is located under the arch of the human foot. Located on the upper portion of the exhaust manifold 46 is a front exhaust reed 48. The exhaust reed 48 is connected to the front pump cell 20 by a front exhaust tube 32. Located in the center of the exhaust manifold 46 is a rear exhaust reed 50. The rear exhaust reed 50 is connected to the rear pump cell 24 by a rear exhaust tube 44. Located on the lower portion of the exhaust manifold 46 is a right exhaust reed 52. The right exhaust reed 52 is connected to the right pump cell 22 by a right exhaust tube 38. The exhaust reeds 46, 50 and 52 allow air to pass through them in only one direction, that is, from the exhaust tubes 32, 44 and 38. The exhaust manifold 46 has one outlet into the outside air which is connected to a tube 54 to pass through the outer sole 14 of the sole 12.

Figure 1B:
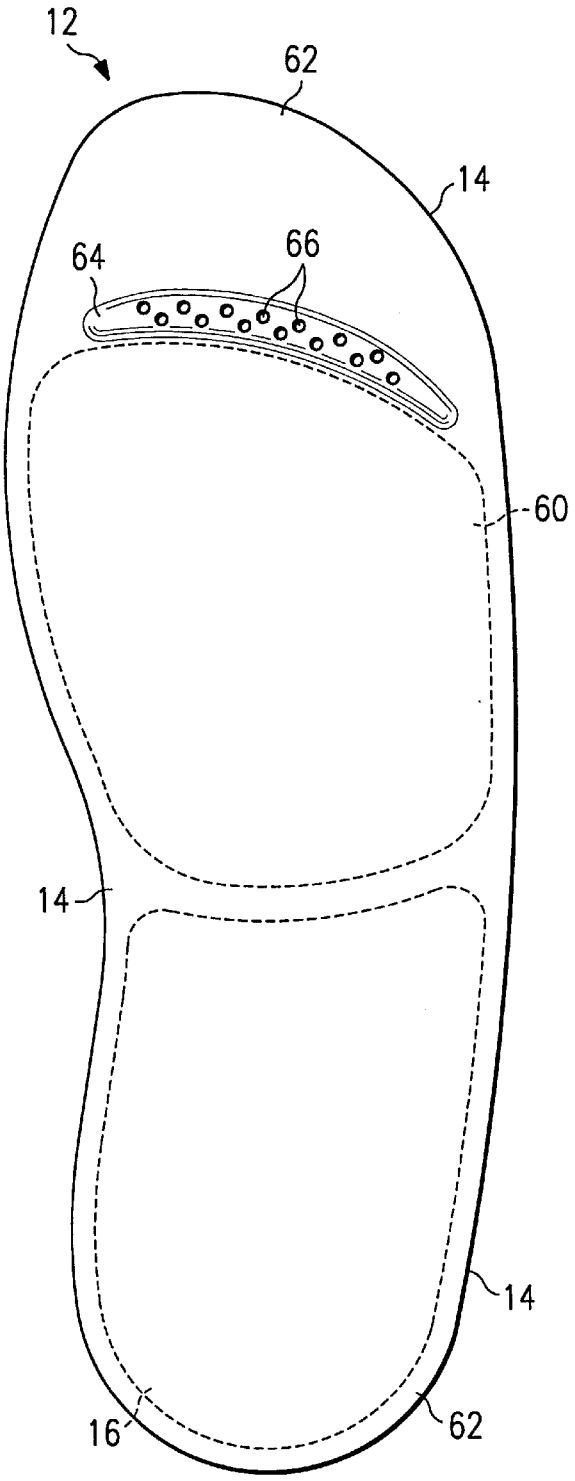
FIG. 1*b* illustrates a top view of the system of the present invention.

Referring now to FIG. 1*b*, there is illustrated a top view of the sole 12. The top layer of the sole 12 is a pad 62 running the full length of the sole 12 covering the outer sole 14. This pad 62 is the same shape as the outer sole 14. A semirigid layer 60 is located just beneath the pad 62 in an area covering the pump cells (not shown). A raised area 64 is located on the top of the pad 62 and coincides with an area just under the base of the phalanges of the first through the fifth shaft of the toes of the human foot. Disposed in the raised area 64 are intake holes 66. These holes 66 perforate the pad 62 to allow air to pass from the air around the foot through the intake holes 66 to the intake manifold 26 (not shown) located just beneath the intake holes 66. The semirigid layer 60 is used to support the foot while allowing the foot to press down against the pump cells (not shown). The heel pad 16 is shown underneath the pad 62.

Figure 1C:
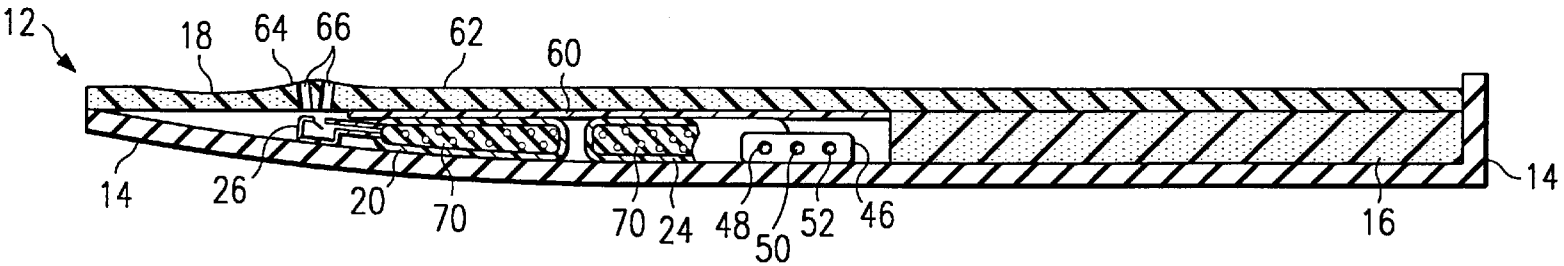
FIG. 1*c* illustrates a side cross-sectional view of the system of the present invention.

Referring now to FIG. 1*c*, there is illustrated a sectional view of the system of the present invention. The outer sole 14 is shown extending from the rear of the shoe across the bottom of the rear of the sole 12 running the full length of the sole 12. The heel pad 16 is shown passing from the rear of the outer sole 14 one-third of the length of the outer sole 14. The exhaust manifold 46 is shown containing the front exhaust reed 48, the rear exhaust reed 50, and the right exhaust reed 52. The rear pump cell 24 is shown, as is the front pump cell 20. The intake manifold 26 is shown. Placed above the front air cell 20 and the rear air cell 24, the semirigid layer 60 runs from the front pump cell 20 to the rear of the exhaust manifold 46. Covering the full length of the sole 12 from the rear of the heel pad 16 to the front of the outer sole 14 is the pad 62. The toe impressions 18 are shown disposed in the pad 62. The raised area 64 is shown just behind the toe impressions 18. The intake holes 66 are shown perforating the pad 62 and disposed in the area of the raised area 64. The intake holes 66 are also disposed just above intake manifold 26. Also shown is the open-celled foam 70 located inside the front pump cell 20 and the rear pump cell 24.

Figure 1D:
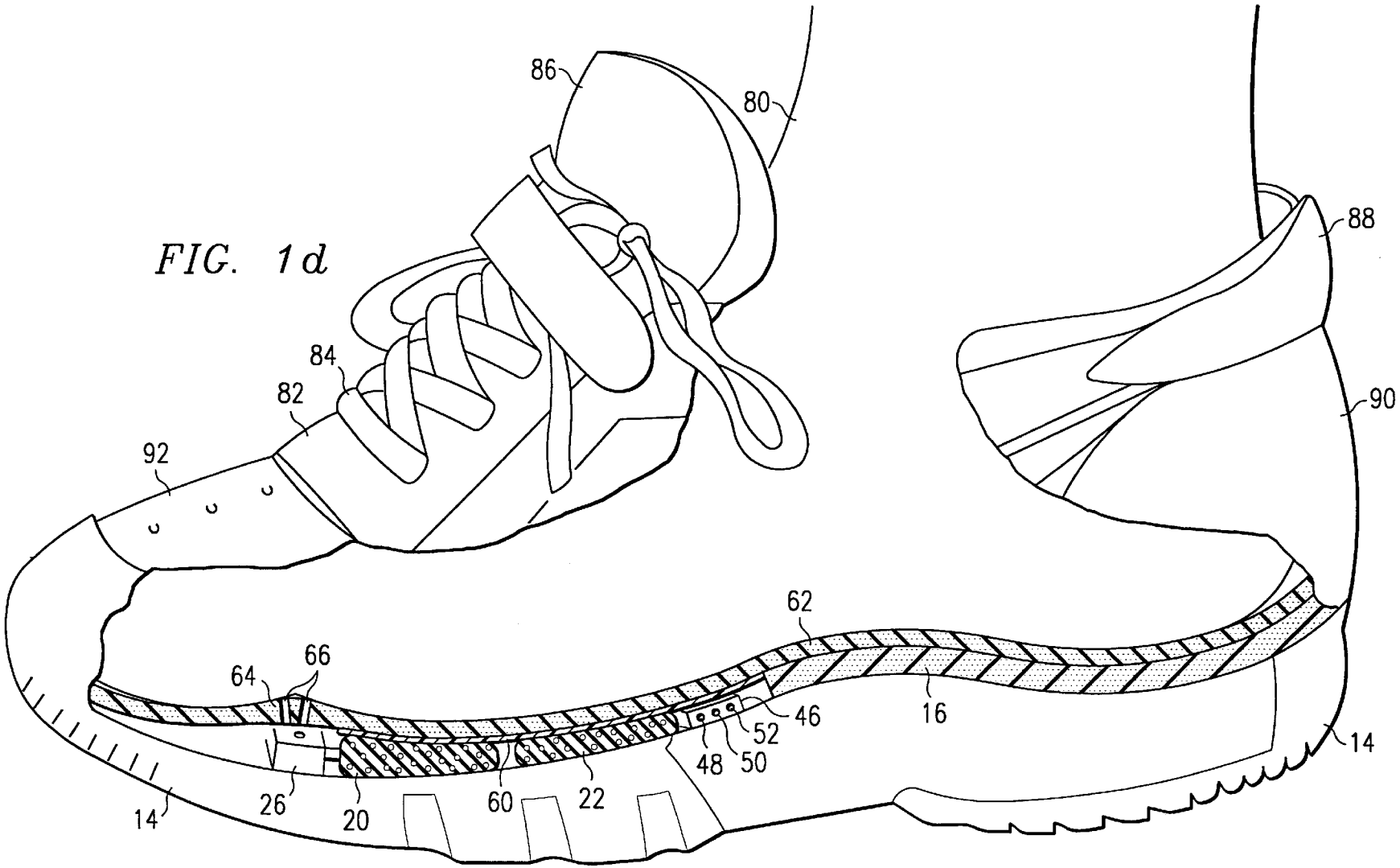
FIG. 1*d* illustrates a side cutaway view of the system of the present invention.

Referring now to FIG. 1*d* there is illustrated a side cutaway view of the system of the present invention. The outer sole 14 is shown running from the front of the human foot to the rear of the human foot 80. A typical tennis shoe upper 82 is shown connected to the outer sole 14. The tennis shoe upper contains laces 84, a tongue 86, a collar 88, and a body 90. The shoe has vents 92 placed in the toe area. The pad 62 is shown running from the heel of the foot 80 to the toes of the foot 80. The raised area 64 is shown positioned under the base phalanges of the foot 80. Intake holes 66 are shown disposed in the pad 62 at the raised area 64. The intake manifold 26 is shown disposed directly beneath the intake holes 66. The front pump cell 20 is shown disposed directly in front of the rear pump cell 22. The exhaust manifold 46 is shown having the front exhaust reed 48, the rear exhaust reed 50, and the right exhaust reed 52 disposed therein. The heel pad 16 is shown disposed between the foot 80 and the outer sole 14. The semirigid layer 60 is shown disposed between the pad 62 and the front pump cell 20 and the rear pump cell 24.

In operation, the human foot (not shown) fits over the sole 12. The human foot is outlined by the outer sole 14. The heel of the human foot fits over the heel pad 16 with the five toes of the human foot each fitting into a corresponding one of the toe impressions 18. The front intake reed 28, the rear intake reed 40, and the right intake reed 34 allow air to pass in only one direction from the interior of the shoe into the tubes 30, 42, and 36. The front exhaust 48, the rear exhaust reed 50, and the right exhaust reed 52 also allow, air to pass in only one direction that being from the exhaust tubes 32, 38, and 44 through the outside exhaust tube 50. Therefore, when the pressure of the foot (not shown) is not pressing on the front pump cell 20, the right pump cell 22, and the rear pump cell 24, the open-celled foam 70 inside the pump cells 20, 22, and 24 causes the pump cells 20, 22, and 24 to expand, thereby drawing air through the intake manifold 26 and through the intake reeds 28, 40, and 34, through the intake tubes 30, 42, and 36, and into the pump cells 20, 22, and 24. This draws air from the interior of the shoe and around the foot into the front pump cell 20, the rear pump cell 24, and the right pump cell 22.

When a person steps with his foot onto a surface, the foot then presses down on the pad 62, the front pump cell 20, the right pump cell 22, and the rear pump cell 24. This compresses the pump cells 20, 22 and 24 and compresses the open-celled foam 70 inside the pump cells 20, 22 and 24. This, in turn, causes the air from the front pump cell 20 to be expelled through the front exhaust tube 32, through the exhaust reed 48, and thereby through the outside exhaust tube 54. This also causes air from the right pump cell 22 to be expelled through the right exhaust tube 38, through the right exhaust reed 52, and through the outside exhaust tube 54. Finally, this causes air inside the rear pump cell 24 to be expelled through the tube 44, through the rear exhaust reed 50, and through the outside exhaust tube 54 into the outside ambient air. This happens with each step.

After a person lifts his foot off the ground to take another step, the air is drawn through the intake reeds 28, 40 and 34, through the intake tubes 30, 36 and 42, and into the pump cells 20, 22 and 24. Air is only drawn through the intake reeds 28, 30 and 44, and not through the exhaust reeds 48, 50 and 52, because air can only be expelled out of the exhaust reeds 48, 50 and 52 in the direction of the outside exhaust tube 54 from the pump cells 20, 22 and 24. Once the pump cells 20, 22 and 24 are filled with air when a person steps onto a surface, the foot presses down on the pump cells 20, 22 and 24, pressing them against the outer sole 14 of the sole 12, causing the pump cells 20, 22 and 24 to be compressed and the air to be expelled through the tubes 32, 42 and 38, through the exhaust reeds 48, 50 and 52, and through the outside exhaust tube 54 into the outside ambient air.

This system, comprising multiple pump cells 20, 22 and 24, and multiple intake reeds 28, 34 and 40, provides consistent air transfer during changing foot positions and walking due to the multiple pump cells 22, 24 and 20 and the semirigid layer 60 placed over the pump cells 20, 22 and 24. Since the pump cells 20, 22 and 24 each have individual intake reeds 28, 40 and 34, individual intake tubes 30, 42 and 36, individual exhaust tubes 32, 44 and 38, and individual exhaust reeds 48, 50 and 52, this allows the individual pump cells 20, 22 and 24 to operate independently from each other. This also causes increased service life due to the fact that the failure of the exhaust reeds 46, 50 and 52 is the most probable cause of system malfunction. Since each pump cell 20, 22 and 24 has its own exhaust reed 46, 50 and 52, the rate of reduction is fractional, since it is unlikely that all of the exhaust reeds 46, 50 and 52 will fail simultaneously.

Figure 2B:
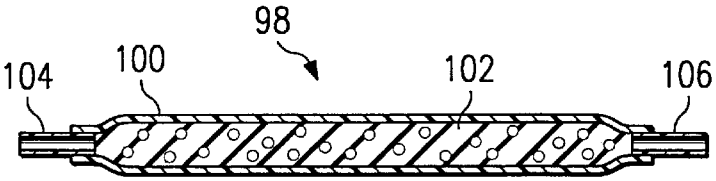
FIG. 2*b* illustrates a cross-sectional view of an assembled pump cell.
Figure 2C:
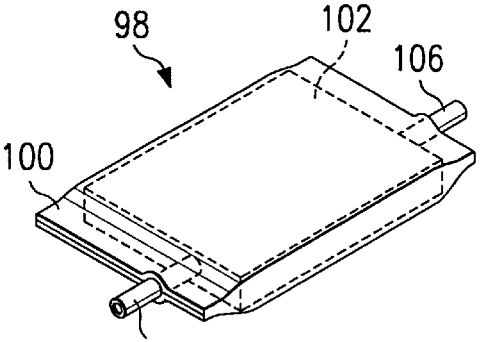
FIG. 2*c* illustrates a perspective view of the pump cell.
Figure 2A:
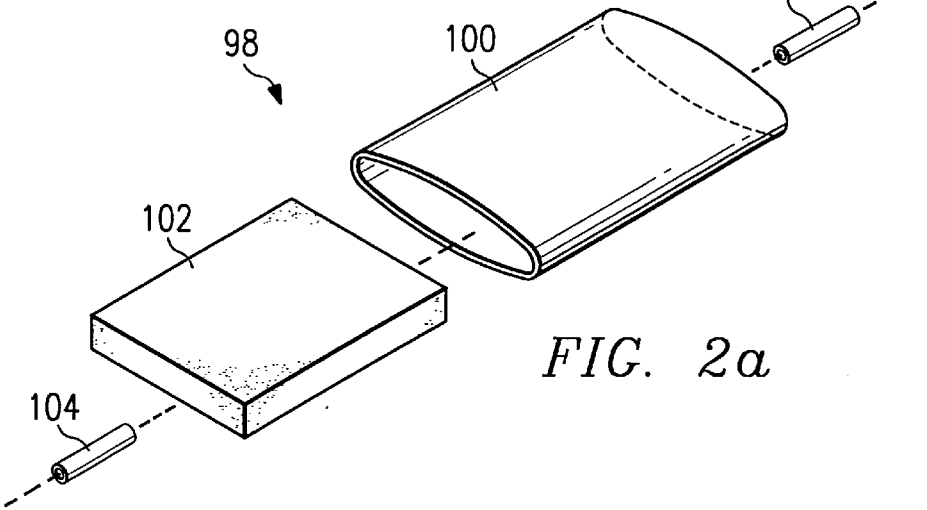
FIG. 2*a* illustrates an exploded diagram of the construction of the pump cells.

Referring now to FIG. 2*a*, there is illustrated an exploded diagram of the construction of a pump cell 98. The pump cell 98 consists of a plastic tube inlet 104, a plastic tube outlet 106, a main tubing 100, and an open-celled foam filler 102. Referring now to FIG. 2*b*, there is illustrated a longitudinal section view of an assembled pump cell 98. The plastic tube inlet 104 is shown inserted to the open-celled foam filler 102, which is inserted into the main tubing 100. The plastic tube outlet 106 is shown also inserted into the open-celled foam filler 102. Referring now to FIG. 2*c*, there is illustrated a perspective view of the pump cell 98. The open-celled foam filler 102 is shown inside the main tubing 100, with the plastic tube inlet 104 inserted through the main tubing 100 into the open-celled foam filler 102. The plastic tube outlet 106 is shown inserted into the open-celled foam filler 102 and through the main tubing 100.

In operation, the open-celled foam filler 102 is normally in an expanded position as shown in FIG. 2*b*, such that it holds the two sides of the main tubing 100 apart from each other. This in turn traps air in the open-celled foam filler 102. Air comes in through plastic tube inlet 104. The air may only flow inward through plastic tube inlet 104 and may only flow out through plastic tube outlet 106. When the main tubing 100 is compressed by a human foot (not shown), the open-celled foam filler 102 is compressed together and the two sides of the main tubing 100 move towards each other. This in turn causes the air inside the open-celled foam filler 102 to be expelled through the plastic tube outlet 106.

Figure 3A:
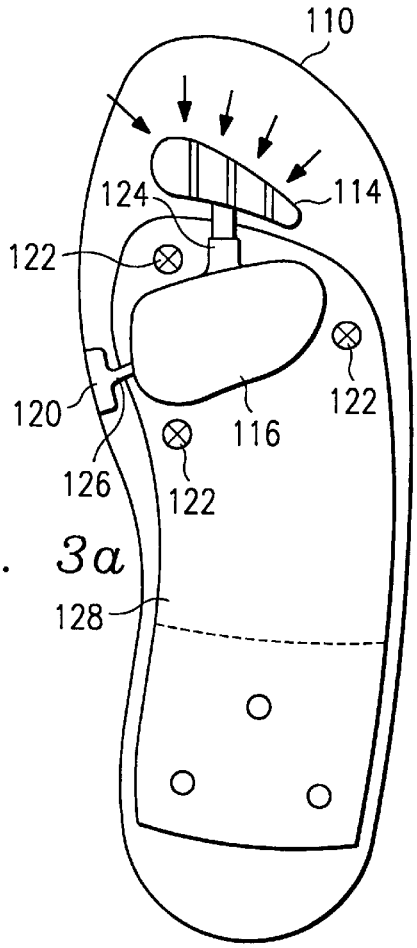
FIG. 3*a* illustrates an alternative embodiment of the present invention.
Figure 3B:
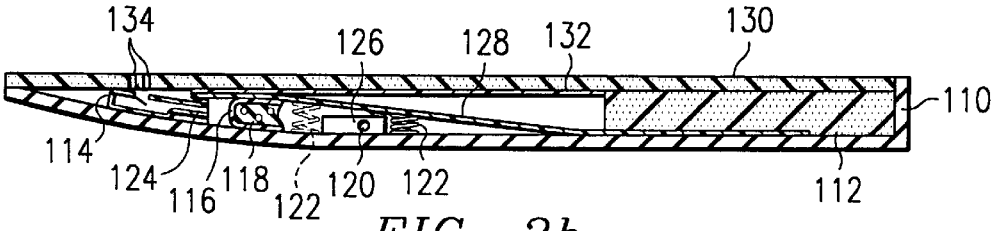
FIG. 3*b* illustrates a cross-sectional view of an alternative embodiment of the present invention.

Referring now to FIGS. 3*a* and 3*b*, there is illustrated an alternative embodiment of the present invention. An outer sole 110 is shown approximately in the shape of an outline of a human foot. A heel pad 112 is shown covering the rear one-third of the outer sole 110. An intake grille 114 is provided. A pump bladder 116 is provided and is filled with an open-celled foam 118. The pump bladder 116 is connected to the intake grille 114 through an inlet reed 124. An exhaust port 120 is provided and is connected to the pump bladder 116 through an outlet reed 126. A pump lever 128 is provided and runs from below the heel pad 112 up to the intake grille 114. Pump return springs 122 are provided and positioned between the outer sole 110 and the pump lever 128. The pump lever 128 is positioned such that it is directly above the pump bladder 116. A semirigid layer 132 (not shown in FIG. 3*a*) is then positioned above pump lever 128, and a pad 130 (not shown in FIG. 3*a*) is positioned above the heel pad 112. The semirigid layer 132 runs the full length of the outer sole 110 from the front of the outer sole 110 to the rear of the outer sole 110. Intake holes 134 are disposed in the pad 130 running through the full height of the pad 130.

In operation, when a human foot is not pressing upon the pad 130, this allows the open-celled foam 118 inside the pump bladder 116 to expand, drawing air from around the toes of a human foot, through the intake holes 134, through the intake grille 114, through the inlet reed valve 124, and into the pump bladder 116. When the human foot is pressed down on the pad 130, it pushes the semirigid layer 132 down upon the pump lever 128, which compresses the open-celled foam 118 in the pump bladder 116 and expels the air in the pump bladder 116 through the outlet reed 126, and then through the exhaust port 120. When pressure is released from the pump lever 128, the pump lever is raised by the pump return springs 122, such that the open-celled foam 118 in the pump bladder 116 may expand to draw in air.

Figure 4A:
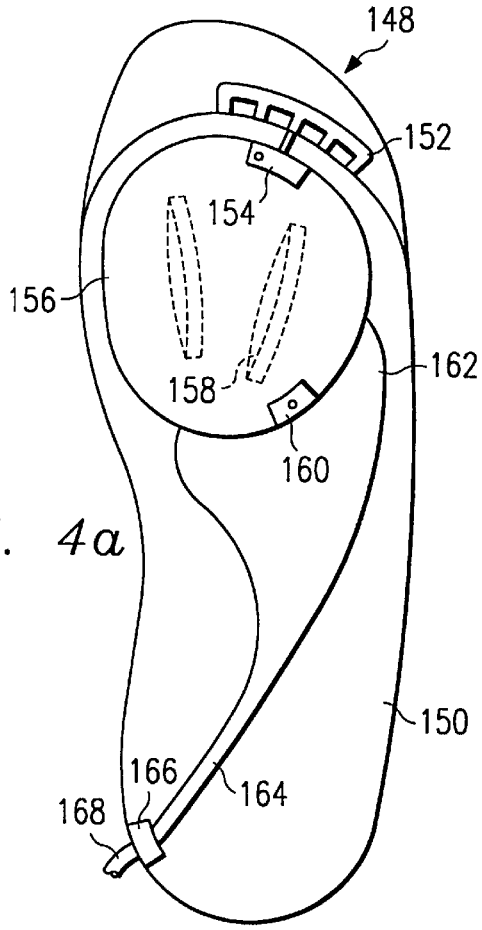
FIG. 4*a* illustrates a cutaway drawing of a shoe insert utilizing the system of the present invention.

Referring now to FIG. 4*a*, there is illustrated a cutaway drawing of a shoe insert 148 utilizing the system of the present invention. The shoe insert 148 consists of a base 150. The insert 148 also consists of an intake manifold 152. The intake manifold 152 is connected to a main pump cell 156 through an intake reed 154 which allows air to travel only from the direction of the intake manifold 152 to the main pump cell 156. The main pump cell 156 has semirigid walls and is expanded by leaf springs 158 disposed on the interior of the main pump cell 156. The main pump cell 156 is connected to a secondary pump cell 162 through a first exhaust reed 160, which allows air to flow only in the direction from the main pump cell 156 to the secondary pump cell 162. An exhaust tube 164 is connected to the secondary pump cell 162. The exhaust tube 164 has disposed near its end a second exhaust reed 166 allowing air to flow only from the secondary exhaust bladder 156 and not into the secondary exhaust bladder 156. A tube 168 is connected to the outward side of the second exhaust reed 166.

Figure 4B:
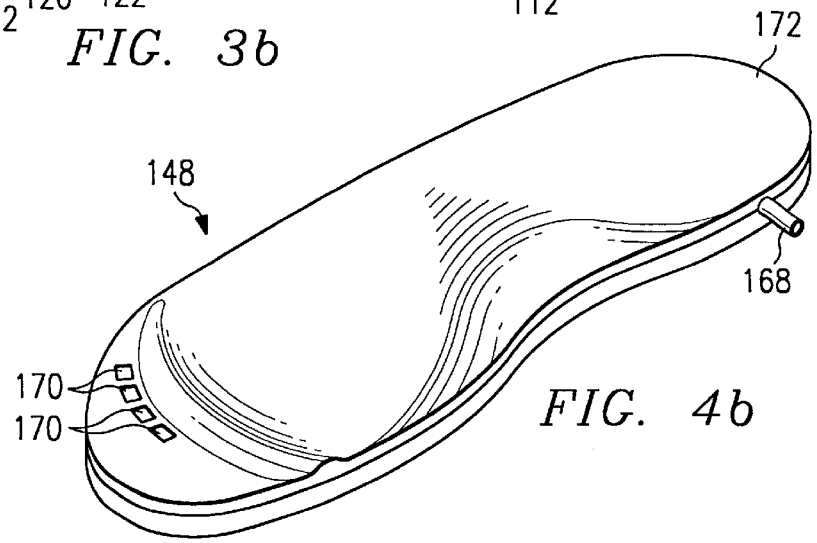
FIG. 4*b* illustrates a perspective view of the shoe insert utilizing the system of the present invention.

Referring now to FIG. 4*b*, there is illustrated a perspective view of the complete insert 148. A pad 172 is disposed over the full length of the base 150. Disposed in the pad 172 near the front of the pad 172 are intake holes 170. The intake holes 170 allow air from around the toes of the foot to travel through the pad 172 to the intake manifold 152.

In operation, the insert 148 can be disposed inside a normal athletic shoe between the foot of the wearer and the sole of the shoe. Once the insert 148 is inserted into a normal athletic shoe between the foot of the wearer (not shown) and the sole of the athletic shoe, the secondary pump cell 162, and the main pump cell 156 are filled with air. When a person first steps down with their heel, their foot presses the air out of the secondary pump cell 162, through the exhaust tube 164, out the second exhaust tube 166, and out the outlet tube 168. When a person rolls onto the ball of their foot, air is expelled from the main pump cell 156, through the exhaust reed 160, and into the secondary exhaust cell 162. When a person then completes his step and lifts his foot off of the ground, the leaf springs 158 in the main pump cell 156 expand the main pump cell 156, drawing air through the intake holes 170 from around the toes of the human foot (not shown), into the intake manifold 152, through the intake reed 154, and into the main pump cell 156. Then the cycle starts over again with the person expelling the air from the secondary pump cell 162, and then expelling the air from the cell 156 into the secondary exhaust cell 162 as stated above.

Figure 5:
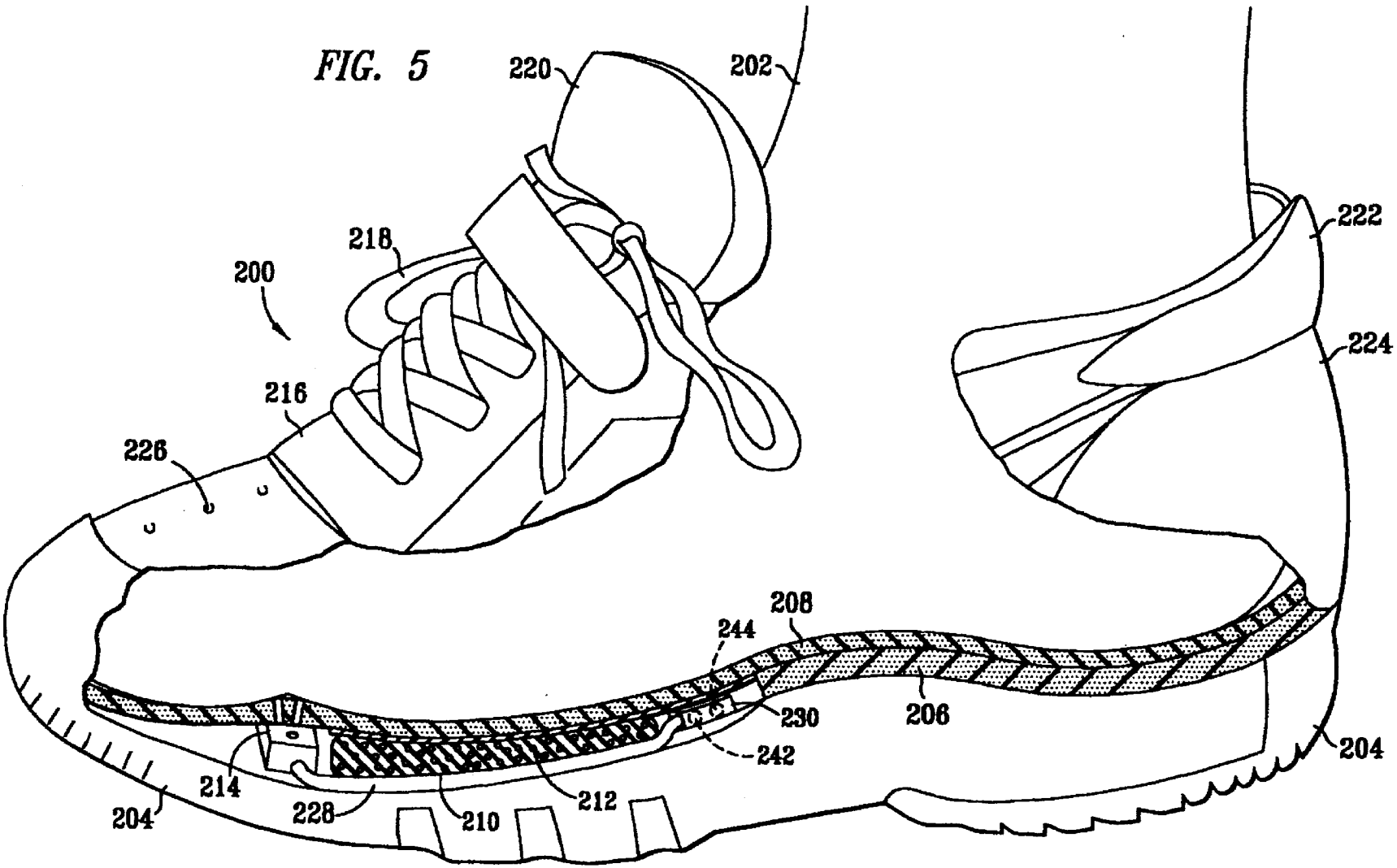
FIG. 5 illustrates a side cutaway view of the ventilated shoe.

Referring now to FIG. 5, there is illustrated a side cutaway view of the system of the present invention. A ventilated shoe 200 is shown. A human foot 202 is provided and is disposed inside the ventilated shoe 200. An outer sole 204 is provided. A typical tennis shoe upper 216 is shown connected to the outer sole 204. The tennis shoe upper contains laces 218, a tongue 220, a collar 222 and a body 224. The ventilated shoe 200 has vents 226 disposed in the toe area. A pump cell 210 is disposed between the human foot 202 and the outer sole 204. Disposed inside the pump cell 210 is open-cell foam 212. The pump cell 210 is disposed in the inner sole 208. Also disposed in the inner sole 208, near the toe portion of the human foot 202, is a filter 214. Connected to the filter 214 is an intake tube 228. The intake tube 228 runs from the filter 214 along the pump cell 210 to the midsection of the human foot 202. A valve pod 230 is disposed near the midsection of the outer sole 204. The valve pod 230 contains two one-way valves, one valve being an intake valve 242 and the other valve being an exhaust valve 244 (shown in FIG. 6*b*). The intake tube 228 is connected to the inlet of the intake valve 242. The outlet of the intake valve 242 is connected to the pump cell 210. The inlet of the exhaust valve 244 is connected to the pump cell 210 and the outlet thereof is connected through an opening 232 to the outside ambient air. A heel pad 206 is disposed in the inner sole 208 between the valve pod 230 and the rear of the shoe 200.

Figure 6A:
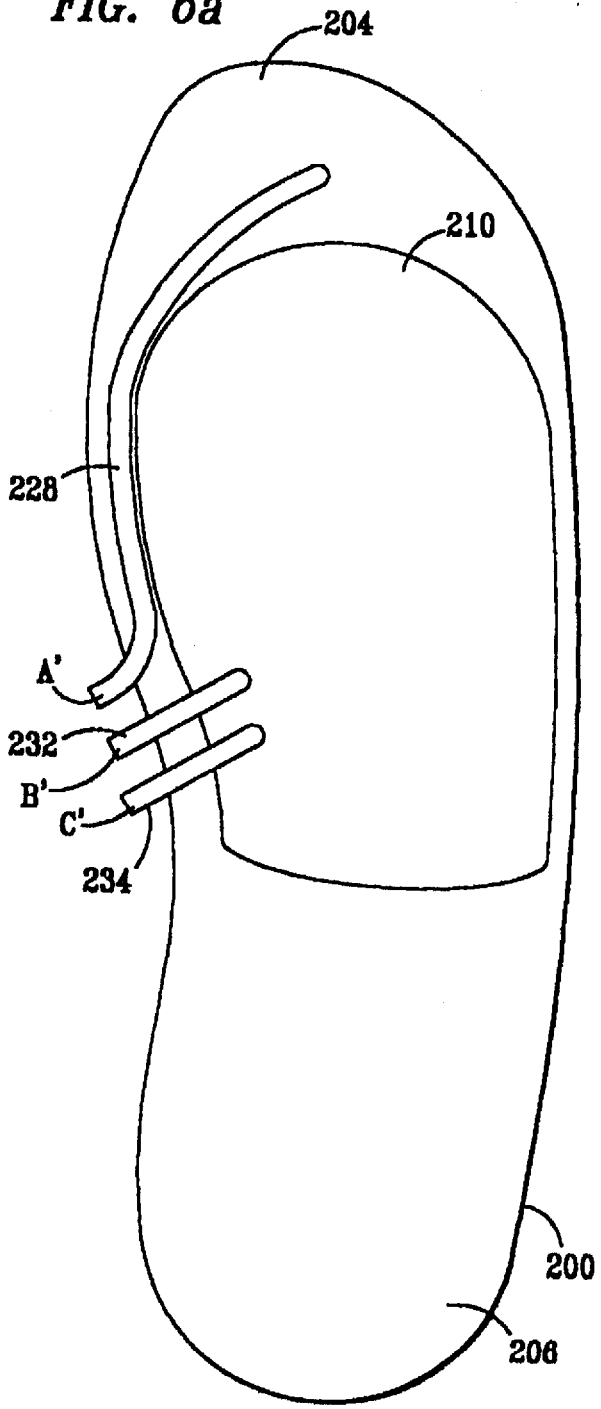
FIG. 6*a* illustrates a top view of the ventilated shoe with the upper and the inner sole removed.

Referring now to FIG. 6*a*, there is illustrated a top view of the ventilated shoe 200 with the upper 216 and the inner sole 208 removed. The outer sole 204 is shown having the shape of an outline of the human foot 202 (shown in FIG. 5). The heel pad 206 is disposed on top of the outer sole 204 and covers the rear one-third area of the outer sole 204. The pump cell 210 is shown disposed on the outer sole 204. Intake tube 228 is shown extending from the toe portion of the outer sole 204 to exit the outer sole 204 at the midsection. The pump intake tube 232 is shown with one end connected inside the pump cell 210 and the other end extending outward from the outer sole 204 near the area where the intake tube 228 extends from the outer sole 204. An exhaust tube 234 is disposed such that it extends from inside the pump cell 210 to the outside of outer sole 204 in the approximate area of the pump intake tube 232. Proximate to the area where the intake tube 228, the pump intake tube 232, and the exhaust tube 234 exit, the outer sole 204 may be recessed such that the area is indented into the outer sole 204.

Figure 6B:
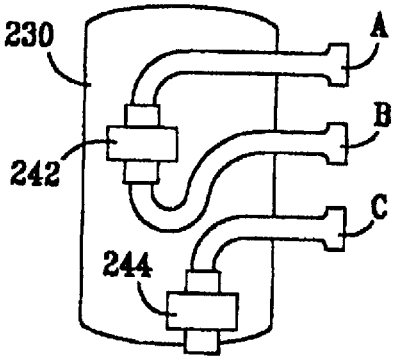
FIG. 6*b* illustrates a cutaway view of the valve pod.

Referring now to FIG. 6*b*, there is illustrated a cutaway view of the valve pod 230. The valve pod 230 contains an intake valve 242 and an exhaust valve 244. The intake valve 242 and the exhaust valve 244 allow air and liquid to pass in only one direction from the inlet to the outlet. The inlet A of the intake valve 242 is connected to the outlet A of the intake 228. The outlet B of the intake valve 242 is connected to the open end B of pump intake tube 232. The inlet C of the exhaust valve 244 is connected to the second end C of the exhaust tube 244 and the outlet of the exhaust valve 244 is connected to the outside ambient air. The valve pod 230 is thus located on the outside of the outer sole 204 of the ventilated shoe 200. This allows for easy cleaning and replacement of the valve pod 230. The pump cell 210 may be bonded together by adhesives exclusively, or may be bonded by heat means. The outlet side of the exhaust valve 244 may be fitted with a charcoal filter or condenser, as needed. The pump intake tube 232 may be located at the left rear of the pump cell 210, as shown in FIG. 6*a*, or it may be located at the extreme rear of pump cell 210, or at the front of pump cell 210. It does not matter where the pump intake tube 232 or the exhaust tube 234 connects to pump cell 210.

Figure 7:
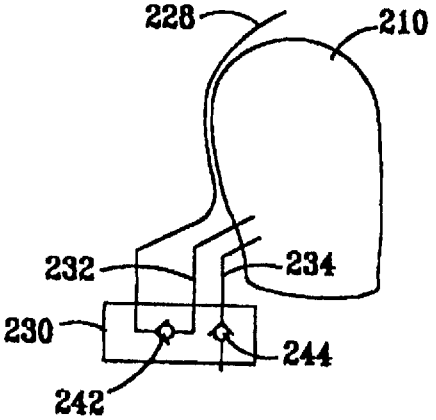
FIG. 7 illustrates a schematic diagram of the ventilated shoe and valve pad.

Referring now to FIG. 7, there is illustrated a schematic diagram of the apparatus shown in FIGS. 6*a* and 6*b*. The pump cell 210 is shown having the pump intake tube 232 connected thereto and the exhaust tube 234 also connected thereto. The intake tube 228 is shown connected to the inlet of intake valve 242. The outlet of intake valve 242 is connected to the pump intake tube 232 whose opposite side is connected to the pump cell 210. The opposite side of exhaust tube 234 is connected to the inlet of exhaust valve 244. The outlet of exhaust valve 244 is connected to the outside ambient air.

In operation, the human foot 202 fits over the outer sole 204 and into the upper 216 of the ventilated shoe 200. The heel of the human foot 202 fits over the heel pad 206. The toes of the human foot fit into the front of the ventilated shoe 200 with the arch between the toes and the foot fitting just over the filter 214. Air is allowed to pass through the filter 214, through the intake tube 228, through the intake valve 242, and through the pump intake tube 232 and to the pump cell 210. This is allowed to happen when the human foot 202 is not exerting pressure on the pump cell 210 and the open-cell foam 212 in the pump cell 210 expands the pump cell 210. This draws air from the interior of the shoe 200 into the pump cell 210. The intake valve 242 only allows air to pass from the intake tube 228 into the pump intake tube 232 in that particular direction. Air is not allowed to pass from the pump cell 210 through the pump intake tube 232 into the intake tube 228. Moisture and liquid, along with air, may be drawn through the filter 214 and into the pump cell 210. Air is then drawn into the shoe 200 through the vents 226 and around the collar 222 to replace the air that is drawn through the filter 214 into the pump cell 210.

When pressure is exerted from the human foot 202 onto the outer sole 204, the pump cell 210 is compressed by the pressure. This in turn compresses the open-cell foam 212 which is inside the pump cell 210. This causes the air or water vapor from the pump cell 210 to be expelled through the exhaust tube 234 and pass through the one-way exhaust valve 244 into the outside ambient air. The exhaust valve 244 does not allow air or liquid from the outside to pass through the exhaust valve 244 into the exhaust tube 234, thereby entering the pump cell 210. When the human foot 202 is then lifted off the ground, the air is once again drawn through the filter 214 through the intake tube 228, through the intake valve 242, and through the pump cell 244 and into the pump cell 210. A cut-off valve (not shown) may be added between the filter 214 and the intake valve 242 along the intake tube 228. If the cut-off valve is activated, the air will no longer be drawn from the area around the human foot 202.

Figure 8A:
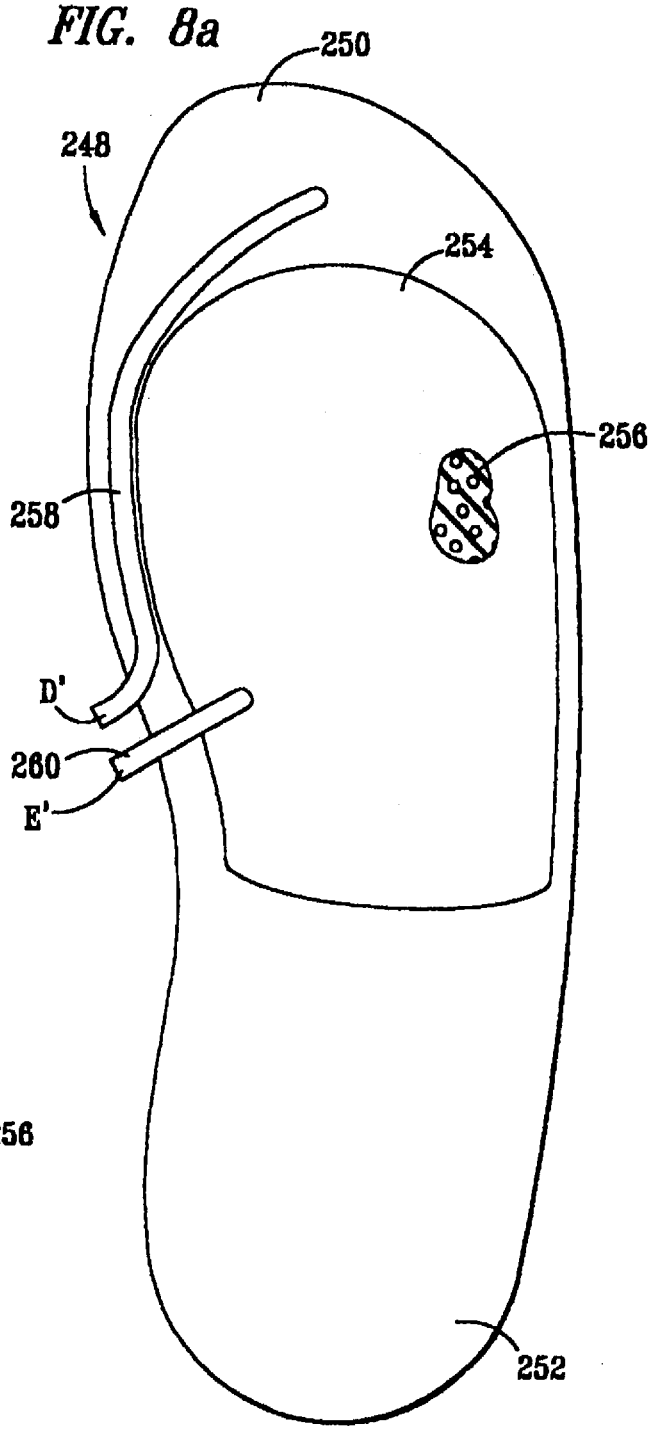
FIG. 8*a* illustrates a top cutaway view of an additional embodiment of a ventilated shoe with the shoe upper and inner sole removed.

Referring now to FIG. 8*a*, there is illustrated a top cutaway view of an additional embodiment of a ventilated shoe 248 with the shoe upper and inner sole removed. An outer sole 250 is provided having a shape of an outline of the human foot 202. A heel pad 252 is disposed on top of the outer sole 250 and covers a rear one-third area of the outer sole 250. A pump cell 254 is shown disposed on the outer sole 250 covering an area from approximately the toe area of the outer sole 250, along two-thirds of the outer sole 250, and also covering nearly the fall width of the outer sole 250. An intake tube 258 is disposed to extend from the toe portion of the outer sole 250 and has an outlet D to the midsection of outer sole 250. A monotube 260 is disposed running from the interior of the pump cell 254 through the outer sole 250 to exit the outer sole 250 at port E, adjacent to the intake tube 258. The monotube 260 may be located at the rear, sides, or front of the pump cell 254. Also, the pump cell 254 may be confined to just the toe section of the outer sole 250, or may run throughout the entire surface area of the outer sole 250. Both the intake tube 258 and the monotube 260 may be merely passages between the pump cell 254 and either the interior of the shoe with respect to intake tube 258 and the exterior of the shoe with respect to monotube 260. The intake tube 258 and the monotube 260 exit the outer sole 250 and are recessed such that the area is indented in the side of the outer sole 250. An open-cell foam 256 or other expandable material may be used to fill the pump cell 254, such that when pressure is released from on top of the pump cell 254, the open-cell foam 256 will expand the pump cell 254.

Figure 8B:
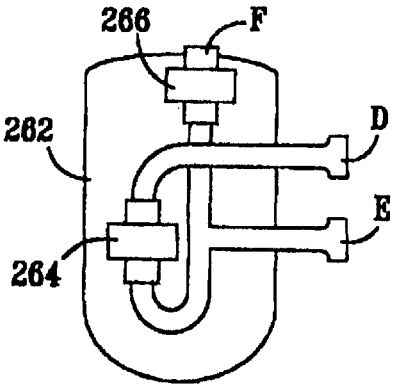
FIG. 8*b* illustrates a cutaway view of a valve pod.

Referring now to FIG. 8*b*, there is illustrated a cutaway view of a valve pod 262. An intake valve 264 is disposed in valve pod 262. Intake valve 264 has an inlet D and an outlet E. The inlet D of the valve 264 is connected to the outlet D of intake tube 258. The outlet E of the intake valve 264 is connected to the monotube 260. An exhaust valve 266 is also provided and disposed in the valve pod 262. The exhaust valve 266 has an inlet E and an outlet F. The outlet F of the exhaust valve 266 is open to the outside air through the side valve pod 262. The inlet E of exhaust valve 266 is connected to monotube 260, and is also the same port as the outlet E of the intake valve 264. The valve pod 262 fits in the recessed area of outer sole 250 and connects to intake tube 258 and monotube 260. The intake valve 264 allows air to pass in a one-way direction from intake tube 258, through monotube 260 and into pump cell 254. The exhaust valve 266 allows air to pass in a one-way direction from pump 254, through monotube 260, and through the exhaust valve 266.

Figure 9:
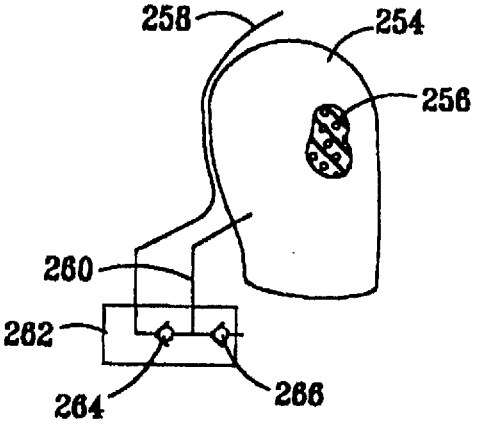
FIG. 9 illustrates a schematic diagram of the additional embodiment of the ventilated shoe and valve pad.

Referring now to FIG. 9, there is illustrated a schematic diagram of the apparatus shown in FIGS. 8*a* and 8*b*. The pump cell 254 is shown having a monotube 260 connected thereto. The intake tube 258 is shown connected to the inlet D of the intake valve 264 of the valve pod 262. The outlet E of intake valve 264 is connected to the monotube 260. The inlet E of the exhaust valve 266 of the valve pod 262 is also connected to the monotube 260 with the outlet F of exhaust valve 266 connected to the outside ambient air. The opposite end of monotube 260 is connected to pump cell 254.

In operation, the human foot fits over the outer sole 250 and into the upper of the ventilated shoe 248. The heel of the human foot 202 fits over the heel pad 252. The toes of the human foot 202 fit into the front of the ventilated shoe 248, over the front of the outer sole 250 with the arch between the toes and the foot fitting just over a filter (not shown), which is positioned just over the inlet of inlet tube 258. When pressure is released from the pump cell 254 and the open-cell foam 256 inside the pump cell 254 causes the pump cell 254 to expand, air is drawn through the filter and into the inlet of intake tube 258. The air and/or liquid then passes through intake valve 264 and through the monotube 260 into the pump cell 254. Once the open-cell foam 256 is fully expanded and the pump cell 254 is full of air, pressure on the pump cell 254 from the human foot compresses the open-cell foam 256, which is inside the pump cell 254. This, in turn, causes any air or liquid inside the pump cell 254 to pass through the monotube 260 and through the exhaust valve 266 to the outside ambient air. Air and/or water is not allowed to pass from the outside ambient air through the exhaust valve 266 and into the pump cell, nor is air or liquid allowed to pass from the pump cell 254, through the intake valve 264, into the intake tube 258, and thereby into the interior of the shoe 248. A cutoff valve (not shown) may be added between the inlet of the intake tube 258 and the intake valve 264 along the intake tube 228. If the cutoff valve is activated, air will no longer be drawn from the area around the human foot.

The exhaust pressure from the exhaust valve 266 may be used to operate connectivity energy devices, such as a pressured drink bottle or inflatable suspension support devices. Also, the rate at which air or water may be exhausted from the exhaust valve 266 may be regulated, such that a pressure cushion is kept in the pump cell 254 and air is only exhausted when the pressure rises above a given air pressure. This regulated release of the exhaust by restriction of the exhaust opening provides a collapsing cushion with a rate determined by the size of the exhaust passage.

Figure 10A:
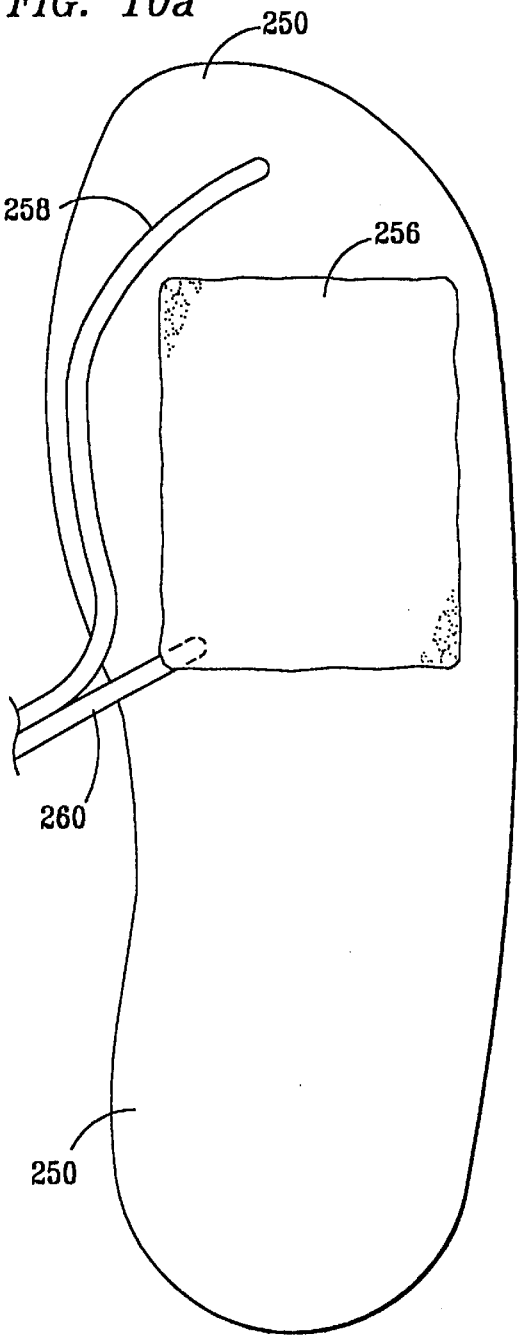
FIG. 10*a* illustrates a top view of a yet further embodiment of a ventilated shoe with the upper removed.

Referring now to FIG. 10*a*, there is illustrated a top view of a ventilated shoe with the upper removed. In a first step of the production technique to manufacture a sole 250 of the ventilated shoe described above with respect to FIGS. 8*a*, 8*b*, and 9, the open-cell foam 256, the intake tube 258, and the monotube 260 are placed in an injection mold for the sole 250. These elements are placed over the sole 250 and in the area to be injection molded to form the insole of the shoe. At this point, closed cell, airtight material (not shown) is forced into the confines of the mold encapsulating the pump foam.

Figure 10B:
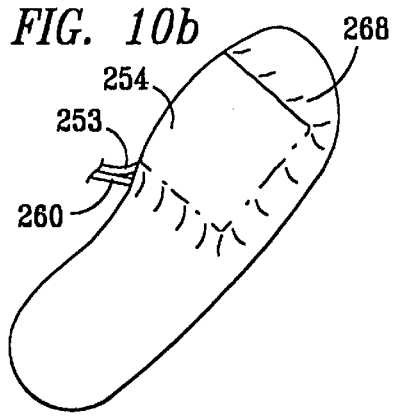
FIG. 10*b* illustrates a finished insole.

Referring now to FIG. 10*b*, there is illustrated the finished insole. The closed cell material 26 forms airtight boundaries around the pump cell 254. This also cushions the area above the outer sole 250, as well as enclosing and forming the airtight pump cell 254. The inner sole material 268 also holds the intake tube 258 and the monotube 260 in place. In this process, the open-cell foam 256 defines the pump perimeter before the closed-cell foam 270 is injected into the molding cavity.

Figure 10C:
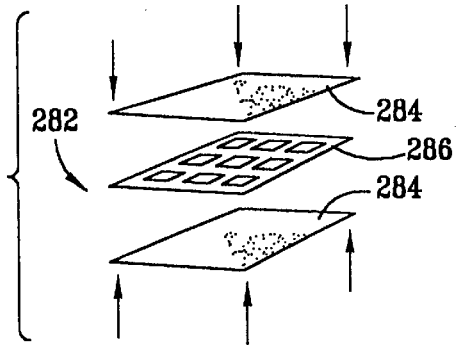
FIG. 10*c* illustrates a composite spring material which may replace the open cell foam.

Referring now to FIG. 10*c*, there is illustrated a composite spring material 282 which may replace the open-cell foam 256. The composite spring consists of multilayers 282 using multiple materials. Two open-cell wafers 284 are placed surrounding a closed-cell foam wafer 286. The two open-cell wafers 284 are attached to the closed-cell wafer 286. The closed-cell wafer 286 may be "waffled" or have other shapes to help absorb shock and to return to its original shape.

Figure 10D:
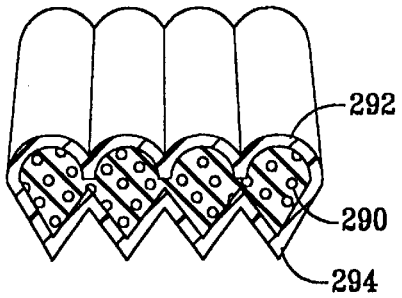
FIG. 10*d* illustrates an alternate composite spring material.

Referring now to FIG. 10*d*, there is illustrated an alternate composite spring material 288. An open-cell foam 290 is deposited between two layers of rubber or vinyl extrusion 292 and 294. The layers 292 and 294 may be formed with a semicircular shape as in the extrusion 292 or in a triangular shape as in the extrusion 294. The space in between 292 and 294 is filled with the open-cell foam 290.

Figure 10E:
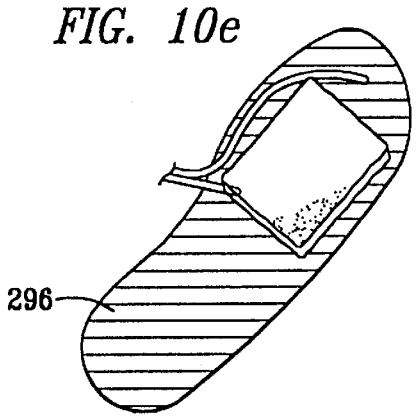
FIG. 10*e* illustrates a top view of a molded insole and takes the portion thereof which is molded.

Referring now to FIG. 10*e*, the area of the injection mold 296 is depicted by hatching.

Figure 11:
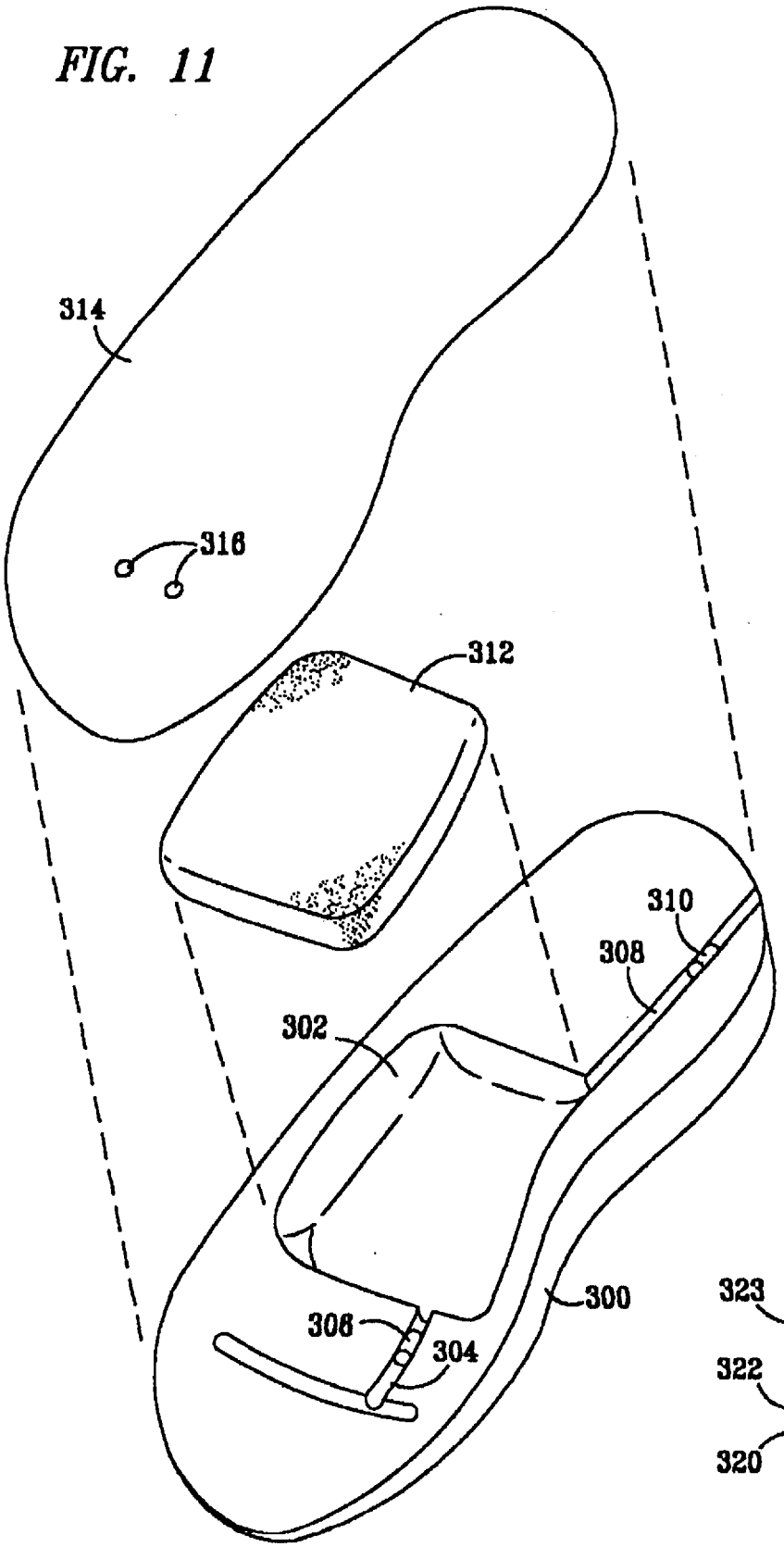
FIG. 11 illustrates a molded pump and hoses.

Referring now to FIG. 11, there is illustrated a molded pump and channels. A midsole 300 is provided. A depression 302 is molded in the midsole. The depression is about one-half the depth of the midsole and runs nearly from side-to-side of the midsole 300. An intake channel 304 is also molded into midsole 300. The intake channel is "T" shaped with the top of the "T" running side-to-side across the toe portion of midsole 300 and the vertical part of the "T" runs into the depression 302. An exhaust channel 308 is also molded into midsole 300. The exhaust channel 308 runs from the rear of the depression 302 to the end of the midsole 300. The depression 302, the intake channel 304, and the exhaust channel 308 are all molded at the time the midsole 300 is molded. Open-cell foam 312 is placed in the molded depression 302 such that half of the open-cell foam 312 rises above the plane of the midsole 300. An airtight flexible membrane 314 is provided having toe channel perforations 316. These toe channel perforations 316 correspond to and are positioned directly over the top of the "T" of intake channel 304.

An intake valve 306 is pressed into intake channel 304. The intake valve 306 allows air to pass from the intake channel 304 into the depression 302. An exhaust valve 310 is pressed into the exhaust channel 308. The exhaust valve 310 allows air to pass from the depression 302 through the exhaust channel 308 and out the rear of the midsole 300. The membrane 314 is bonded over the midsole 300, intake valve 306, exhaust valve 310, exhaust channel 308, intake channel 304, and molded depression 302. The membrane 314 is sealed in an airtight manner to the flat portions of the midsole 300 which were not molded into the channels 308 or 304 or the depression 302.

When pressure is released from the membrane 314, the open-cell foam 312 expands and draws air or water through the toe perforations 316 into the intake channel 304. The air is then drawn through the intake valve 306 and into the depression 302 and open-cell foam 312. When pressure is placed on the membrane 314, air is expelled from the open-cell foam 312 and the depression 302, through the exhaust channel 308, through the exhaust valve 310, and into the outside ambient air. The valve shown in FIG. 11 could be normal one-way air valves or could be molded flap valves as shown in FIG. 12.

Figure 12:
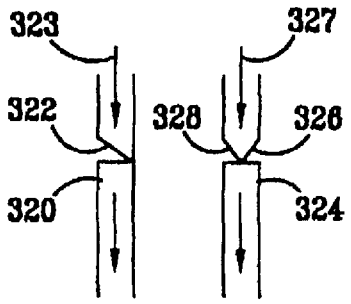
FIG. 12 illustrates two molded flat valves.

Referring now to FIG. 12, there are illustrated flap valves. A single molded flap valve 320 has a single flap 322 which is pressed open from air passing in the direction of arrow 323. If air were to try to attempt to pass in an opposite direction to the direction of the arrow 323, the flap would be held shut and air would not be able to pass through the valve 320. A dual molded flap 324 has two molded flaps 326 and 328. When air is being pressed in the direction of arrow 327, the flaps 326 and 328 are pushed open and air is allowed to pass. When air attempts to move in an opposite direction to the direction of the arrow 327, the flaps 326 and 328 are pressed closed. The flaps 322, 326 and 328 are molded using the same materials and at the same time that the midsole 300 was molded, and would eliminate the need to use separate valves as shown in FIG. 11.

Figure 13:
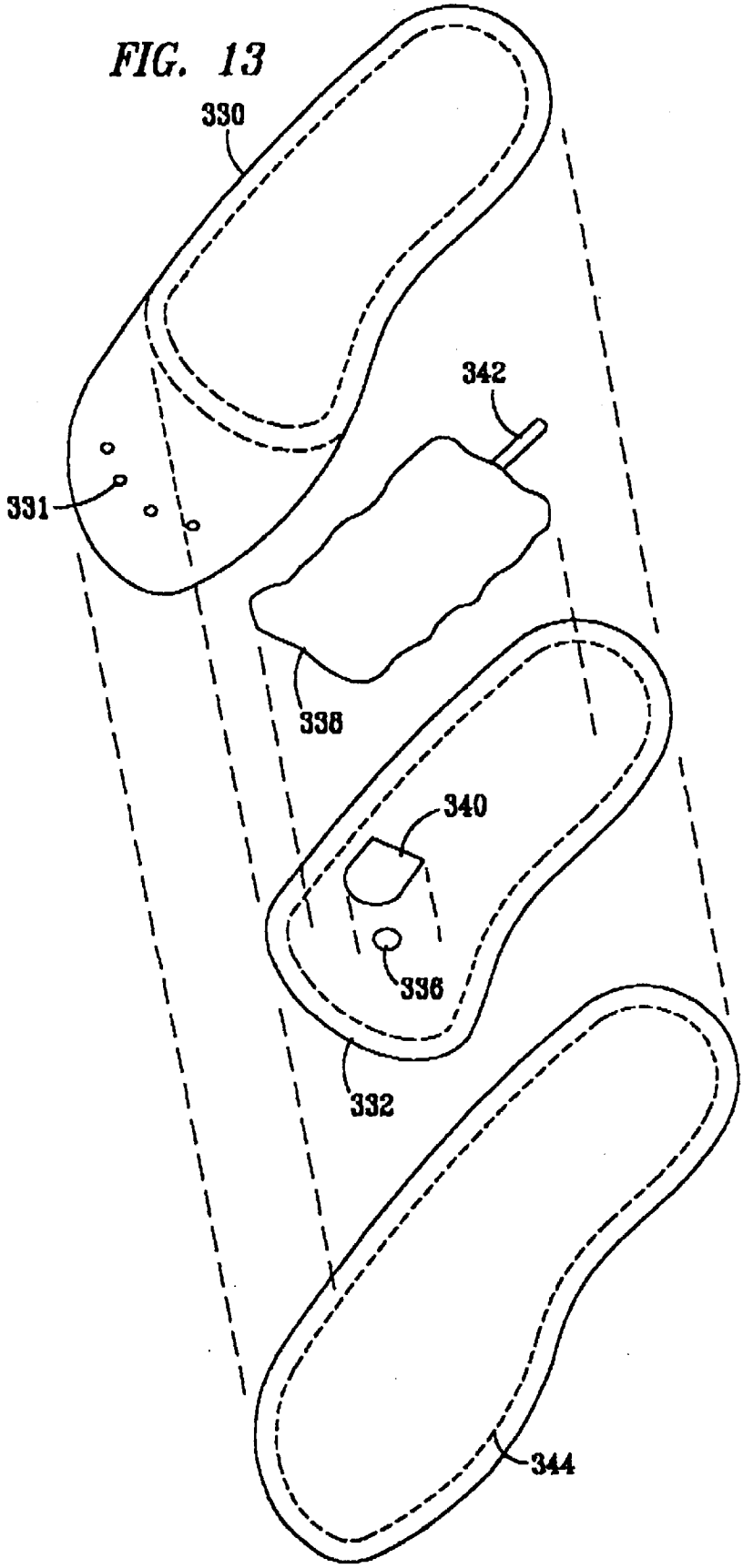
FIG. 13 illustrates a membrane pump with integrated intake.

Referring now to FIG. 13, there is an exploded view of a membrane pump with integrated intake. A top layer 320 is provided. The top layer 330 is in the shape of the sole of a human foot running the full length from heel to toe. Toe perforations 331 are provided in the area that would be under the human toes of the top layer 330. A valve layer 332 is provided running from the end of the heel area approximately two-thirds of the distance to the toe area. The valve layer 332 has disposed in it an intake hole 336. Disposed on top of the intake hole 336 is the flap valve 340. The flap valve 340 is attached to the valve layer 342 such that the flap valve 340 lays directly over the intake hole 336. Open-cell foam 338 is disposed between the valve layer 332 and the top layer 330. Exit tube 342 is disposed in the rear of the foam 338 extending to the rear. The top layer 330 and valve layer 332 are welded together along the perimeter of valve layer 332. The foam 338 and the exit tube 342 are captured in between the top layer 330 and the valve layer 332. A bottom layer 344 is provided and is in the shape of the hole of a human foot. The bottom layer 344 runs the full distance from the heel to the toe area of the human shoe. The bottom layer 344 is then welded to top layer 330. This leaves the forward one-third consisting of the bottom layer and the top layer without having foam in between and the rear two-thirds covered by the top layer 330, the valve layer 332, the foam 338, and the bottom layer 344. The weld between the top layer 330 and the valve layer 332 is an airtight weld forming an airtight cell around the foam 338 in exit tube 342.

In operation, when no pressure is placed on top layer 330, air is drawn through the toe perforations 331, through the intake hole 336, and then through the flap valve 340 into the open-cell foam 338. When pressure is exerted on top layer 330, air is expelled through the exit tube 342.

In summary, there has been provided an air-cooled shoe operable to ventilate the interior of the shoe and the area around a human foot. An outer sole having a toe portion, a ball portion, and a heel portion is provided. A shoe upper is formed above the outer sole and is attached to the outer sole. A pump array is disposed above the ball portion of the outer sole. The pump array includes an airtight pump cell defined by a flexible material and filled with an open-cell material which causes the pump cell to expand and fill with air. The pump cell has an air intake disposed on the toe portion of the outer sole, and an air exhaust connected to the outside ambient air. A semirigid layer is disposed over the entirety of the pump array.

Although the preferred embodiment has been described in detail, it should be understood that various changes, substitutions and alterations can be made therein without departing from the spirit and scope of the invention as defined by the appended claims.

What is claimed is:

1. An air-cooled shoe to be worn on a human foot operable to ventilate an interior of said shoe and the area around the human foot, comprising:

an outer sole having a toe portion, a ball portion and a heel portion;

a shoe upper formed above said outer sole and attached to said outer sole for surrounding the human foot;

said interior of said shoe defined to extend between said outer sole and said shoe upper;

a pump disposed under the human foot, said pump including an air-tight pump cell defined by a flexible material and filled with an expandable material which causes said pump cell to expand and fill with air, said pump cell having a pump intake having a first and a second end with said first end thereof connected to said pump cell, said pump cell also having a pump exhaust having a first and a second end with said first end thereof connected to said pump cell;

an air intake having a first and a second end, said air intake being mounted to said shoe such that said first end thereof is disposed proximate to said toe portion of the outer sole, inside said shoe upper, and in fluid communication with said interior of said shoe;

a first one-way valve having an inlet and an exhaust, said first one-way valve being mounted to said shoe such that said exhaust thereof is in fluid communication with the outside ambient air and said inlet thereof is in fluid communication with said second end of said pump exhaust so that air and liquid may flow only from said second end of said pump exhaust to the outside ambient air; and a second one-way valve having an inlet and an exhaust, said second one-way valve being mounted to said shoe such that said exhaust thereof is in fluid communication with said second end of said pump intake and the inlet thereof is in fluid communication with said second end of said air intake so that air and liquid may flow only from said second end of said air intake to said second end of said pump intake.

2. The apparatus of claim 1, wherein said first one-way valve and said second one-way valve are disposed in a pod which is detachably mounted to said outer sole.

3. The apparatus of claim 1, wherein said expandable material comprises multiple layers of multiple materials.

4. The apparatus of claim 1, wherein said exhaust of said first one-way valve is restricted, thereby regulating the release of air from said pump, causing said pump cell to collapse slowly.

5. The apparatus of claim 1, wherein said pump is activated by the pressure of a human foot pressing against said pump cell and thereby compressing said pump cell, causing air to be expelled through said pump exhaust.

6. The apparatus of claim 1, wherein said expandable material disposed within said pump cell comprises an open cell foam.

7. A method of ventilating the interior of the shoe and the area around the human foot, comprising:

drawing air from the interior of the shoe and into an air intake having a first and a second end, the first end of the air intake being disposed proximate to the toe portion of the outer sole, inside the shoe upper, and in fluid communication with the interior of the shoe;

pumping air from the air intake to the outside ambient air using a pump disposed under the human foot and mounted to the shoe, the pump including an air-tight pump cell defined by a flexible material and filled with an expandable material which causes the pump cell to expand and fill with air, the pump cell including a pump intake having a first and a second end with the first end thereof in fluid communication with the pump cell, and the second end of the pump intake in fluid communication with the interior of the shoe, the pump cell also having a pump exhaust having a first and a second end with the first end thereof connected to the pump cell;

allowing air and liquid to flow only from the second end of the pump exhaust to the outside ambient air using a first one-way valve having an inlet and an exhaust, the first one-way valve being mounted to the shoe such that the exhaust thereof is in fluid communication with the outside ambient air and the inlet thereof is in fluid communication with the second end of the pump exhaust; and allowing air and liquid to flow only from the second end of the air intake to the second end of the pump intake using a second one-way valve having an inlet and an exhaust, the second one-way valve being mounted to the shoe such that the exhaust thereof is in fluid communication with the second end of the pump intake and the inlet thereof is in fluid communication with the second end of the air intake.

8. The method of claim 7, and further comprising the step of disposing the first one-way valve and the second one-way valve in a pod which is detachably mounted to the other sole.

9. The method of claim 7, wherein the expandable material comprises multiple layers of multiple materials.

10. The method of claim 7, and further comprising the step of restricting the exhaust of the first one-way valve, thereby regulating the release of air from the pump, thereby providing a collapsing cushion.

11. The method of claim 7, wherein the pump is activated by the pressure of a human foot pressing against the pump cell and thereby compressing the pump cell, causing air to be expelled through the pump exhaust.

* * * * *